US006581517B1

(12) United States Patent
Becker et al.

(10) Patent No.: US 6,581,517 B1
(45) Date of Patent: Jun. 24, 2003

(54) PRINTING-MACHINE CYLINDER, ESPECIALLY AN IMPRESSION CYLINDER, FOR A SHEET-FED ROTARY PRINTING MACHINE, AND METHOD OF PRODUCTION

(75) Inventors: Willi Becker, Bammental (DE); Andreas Fricke, Eberbach (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/410,832

(22) Filed: Oct. 1, 1999

(30) Foreign Application Priority Data

Oct. 1, 1998 (DE) ..... 198 45 214

(51) Int. Cl.[7] ..... B41F 27/00

(52) U.S. Cl. ..... 101/389.1; 271/5; 271/94; 271/99; 271/112; 271/196; 271/276

(58) Field of Search ..... 101/389.1, 246, 101/409; 271/276, 277, 195, 196, 303, 3.23, 5, 11, 90, 94, 96–98, 112, 132; 492/56; 226/95, 194

(56) References Cited

U.S. PATENT DOCUMENTS

| | | | | | |
|---|---|---|---|---|---|
| 3,710,470 | A | * | 1/1973 | Krake | 492/55 |
| 4,145,040 | A | * | 3/1979 | Huber | 271/276 |
| 4,269,405 | A | * | 5/1981 | Mitzel | 271/94 |
| 4,270,969 | A | * | 6/1981 | Kelley | 271/112 |
| 4,583,729 | A | * | 4/1986 | Blumle | 271/276 |
| 4,666,139 | A | * | 5/1987 | Filewich | 271/112 |
| 4,688,784 | A | * | 8/1987 | Wirz | 271/195 |
| 4,838,982 | A | * | 6/1989 | Klaeser et al. | 271/276 |
| 4,882,015 | A | * | 11/1989 | Oeggerli | 205/75 |
| 4,998,658 | A | * | 3/1991 | Distefano et al. | 226/95 |
| 5,119,550 | A | * | 6/1992 | Baughman et al. | 271/94 |
| 5,186,451 | A | * | 2/1993 | Hirao | 271/196 |
| 5,241,907 | A | | 9/1993 | Dörsam et al. | 101/409 |
| 5,291,260 | A | * | 3/1994 | Johnson | 271/276 |
| 5,411,245 | A | * | 5/1995 | Springer et al. | 270/20.1 |
| 5,716,048 | A | * | 2/1998 | Morrissette | 101/389.1 |
| 5,779,236 | A | * | 7/1998 | Duncan, Jr. et al. | 271/276 |
| 5,813,669 | A | * | 9/1998 | Horii | 271/94 |

FOREIGN PATENT DOCUMENTS

| | | |
|---|---|---|
| DE | 1 147 243 | 4/1963 |
| DE | 25 09 680 A 1 | 9/1976 |
| DE | 28 28 318 A1 | 1/1980 |
| DE | 37 10 341 A1 | 11/1987 |
| DE | 38 27 071 C2 | 2/1990 |
| DE | 41 16 510 A1 | 12/1991 |
| DE | 195 45 799 C1 | 1/1997 |
| DE | 196 15 730 A1 | 10/1997 |
| EP | 0 165 477 B1 | 2/1990 |
| EP | 0 924 067 A1 | 6/1999 |
| GB | 789681 | 1/1958 |
| JP | 59 031 245 | 2/1984 |
| JP | 09 123 395 | 5/1997 |
| JP | 10 175 338 | 6/1998 |

* cited by examiner

*Primary Examiner*—Eugene H. Eickholt
(74) *Attorney, Agent, or Firm*—Laurence A. Greenberg; Werner H. Stemer; Ralph E. Locher

(57) ABSTRACT

A printing-machine cylinder includes a basic cylinder body and a covering element fitted to the basic cylinder body, one of the basic cylinder body and the covering element being formed with a multiplicity of recesses connectable to one of a suction-air source and a blast-air source and having, in the region of the recesses, through-channels extending from the recesses to the peripheral surface of the covering element and defining blasting/suction sections for acting upon the underside of a sheet conveyed on the peripheral surface of the cylinder; a printing machine Including the cylinder; and a method for producing the cylinder.

23 Claims, 5 Drawing Sheets

PRINTING-MACHINE CYLINDER, ESPECIALLY AN IMPRESSION CYLINDER, FOR A SHEET-FED ROTARY PRINTING MACHINE, AND METHOD OF PRODUCTION

BACKGROUND OF THE INVENTION

Field of the Invention

The invention relates to a printing-machine cylinder, especially an impression cylinder, for a sheet-fed rotary printing machine, and to a method for producing such a printing-machine cylinder.

When sheets are being transported through a sheet-fed rotary printing machine, they are printed in a conventional manner in a printing nip formed between an impression cylinder and an associated blanket cylinder, and are then fed, by one or more transfer cylinders, to a downstream printing unit or a reversing or turning device. In order to prevent smearing of the freshly printed side of the sheet on the transfer cylinders, it has become known heretofore to provide openings in the peripheral surface of the cylinders, through which blast air is blown for carrying the sheets on the peripheral surface of the transfer cylinders without smearing.

Both in the case of the sheet transfer cylinders described above and in the case of impression cylinders of sheet-fed rotary printing machines which are assigned to a reversing device, and in which, during first-form and perfecting operation, the sheets are carried on the upline impression cylinder and the trailing edge of the sheets is accepted by a gripper device of the downline transfer cylinder, it has become known heretofore to suck the sheet onto the peripheral surface of the cylinder in order to hold it on the peripheral surface.

The published non-prosecuted German Patent Application (DE-OS) 41 26 643 A1 discloses a transfer cylinder for a sheet-fed rotary printing machine having a basic cylinder body formed by four supporting disks whereon a total of three supporting elements are fastened. Each of the supporting elements has a sandwich-like construction, at the center of which, suction chambers are defined by a metal sheet folded in a serpentine manner and covered towards the outside of the cylinder by a sheet-metal covering having a thin wall and curved so as to correspond to the curvature of the cylinder. Each of the chambers has a flow connection to the environment via associated openings in the sheet-metal covering, and can have suction air applied thereto via a rotary valve, in order to suck a sheet onto the peripheral surface of the cylinder and smoothen it. Because of the thin-walled folded metal sheet used to form the chambers, and the associated sandwich-like construction of the cylinder, the latter is not suitable for use as an impression cylinder in a printing unit of a sheet-fed rotary printing machine.

The published European Patent Document EP 0 165 477 B1 has disclosed a sheet-fed rotary printing machine with a reversing or turning device having an impression cylinder arranged upline of the reversing device and onto which the sheets to be reversed or turned are sucked and held. The impression cylinder has a solid basic body, in which suction-air or blast-air feed channels, which extend axially over the entire width of the cylinder, are formed. From each of the feed channels, a multiplicity of radial holes or bores extend to the peripheral surface of the basic cylinder body. In addition, a textured film is drawn onto the peripheral surface of the basic cylinder body and, in the region of the radial bores, is porous or is formed with openings through which a sheet transported on the cylinder can be sucked against the peripheral surface and lifted off the latter, respectively. From this published. European patent document, it is also known to provide a transfer cylinder, that is constructed as a storage drum and is covered with a porous film, with a suction box that can be moved so as to adapt it to different sheet formats and that sucks the trailing edge of a sheet to be reversed or turned, against and onto the peripheral surface of the transfer cylinder. Because of the feed holes, which extend in the axial direction over the entire width of the impression cylinder, and the numerous fine radial holes or bores to be introduced into the peripheral surface of the basic body of the impression cylinder, the production of the described impression cylinder proves to be extremely complicated and costly.

Because of the comb-like or finger-like configuration of the peripheral surface of the transfer cylinder, that is associated with the ability of the suction box to be moved, the transfer cylinder is not suitable likewise for use as an impression cylinder in a sheet-fed rotary printing machine, because the comb-like structure of the peripheral surface is transferred to the printed image and has a lasting detrimental effect upon the latter.

SUMMARY OF THE INVENTION

It is accordingly an object of the invention to provide a printing-machine cylinder, especially an impression cylinder for a sheet-fed rotary printing machine, that is simple and inexpensive to produce and that permits sheets carried on the cylinder to be both sucked onto it and blown off it.

Furthermore, it is an object of the invention to provide a production method by which a printing-machine cylinder, especially an impression cylinder of a sheet-fed rotary printing machine that has a peripheral surface provided with blast or suction openings, can be produced in a simple and more cost-effective manner.

With the foregoing and other objects in view, there is provided, in accordance with one aspect of the invention, a printing-machine cylinder comprising a basic cylinder body and a covering element fitted to the basic cylinder body, one of the basic cylinder body and the covering element being formed with a multiplicity of recesses connectable to one of a suction-air source and a blast-air source and having, in the region of the recesses, through-channels extending from the recesses to the peripheral surface of the covering element and defining blasting/suction sections for acting upon the underside of a sheet conveyed on the peripheral surface of the cylinder.

In accordance with another aspect of the invention, there is provided a printing-machine cylinder comprising a basic cylinder body having a multiplicity of recesses formed therein and being connectable to one of a suction-air source and a blasting-air source, and having a covering element fitted to the basic cylinder body and, in the region of the recesses, being formed with through-channels extending from the recesses to the peripheral surface of the covering element and defining blasting/suction sections for acting upon the underside of a sheet being conveyed on the peripheral surface of the cylinder.

In accordance with a further aspect of the invention, there is provided a printing-machine cylinder comprising a basic cylinder body, and a covering element fitted to the basic cylinder body and formed on the inside thereof with a multiplicity of recesses connectable to one of a suction-air source and a blast-air source and, in the region of the recesses, being formed with through-channels extending from the recesses to the peripheral surface of the covering element, and defining blasting/suction sections for acting upon the underside of a sheet conveyed on the peripheral surface of the cylinder.

In accordance with another feature of the invention, the through-channels have a section of relatively larger diameter and a section of relatively smaller diameter.

In accordance with a further feature of the invention, the section of relatively larger diameter is formed as a bore in the covering element and extends in a direction from the center of the cylinder.

In accordance with an added feature of the invention, the blasting/suction sections are arranged substantially in rows on the peripheral surface of the cylinder.

In accordance with an additional feature of the invention, the rows extend substantially parallel to one another.

In accordance with yet another feature of the invention, the rows extend in the axial direction.

In accordance with yet a further feature of the invention, as viewed in the direction of rotation of the cylinder, the rows are of decreasing length.

In accordance with an added feature of the invention, the rows extend in the peripheral direction.

In accordance with yet an additional feature of the invention, the rows extend substantially in a V-shape or ray shape.

In accordance with still another feature of the invention, the printing-machine cylinder includes a connecting line for applying one of suction air and blasting air in common to the recesses assigned to a row.

In accordance with still a further feature of the invention, the printing-machine cylinder includes valves assigned to the recesses for connecting the recesses, individually or in groups, to the one of the suction-air source and the blasting-air source.

In accordance with still an added feature of the invention, the recesses are subjectible to the application of said one of suction air and blast air depending upon the sheet format to be processed, in a manner that only the blasting/suction sections underneath a sheet conveyed on the cylinder have the one of suction air and blast air applied thereto.

In accordance with still an additional feature of the invention, the printing-machine cylinder includes a control device for controlling a feeding of the one of suction air and blast air to the recesses.

In accordance with another feature of the invention, all of the recesses are connectable simultaneously to the one of the suction-air and blast-air sources via the control device.

In accordance worth a further feature of the invention, the through-channels in the covering element have a cross section widening in a direction towards the recesses.

In accordance with an added feature of the invention, the peripheral surface of the covering element has a porous film applied thereto, wherein those sections of the through-channels which have a relatively smaller diameter are formed.

In accordance with an additional aspect of the invention, there is provided a printing machine having the cylinder that is formed as an impression cylinder arranged upline of a reversing device, the control device, during first-form and perfecting operation, serving to connect the recesses, in a region between a printing nip and a transfer center line between the impression cylinder and a downline sheet-carrying cylinder, to the suction-air source, in order to hold the sheets on the peripheral surface of the cylinder.

In accordance with another feature of the invention, the control device, during first-form and perfecting operation, serves to connect the recesses, in a transfer region that as one of directly upstream and directly downstream of the transfer center line and wherein a trailing edge of the sheet is acceptable by a gripper device of a downline sheet-carrying cylinder, to the blast-air source.

In accordance with a further aspect of the invention, there is provided a printing-machine cylinder comprising a basic cylinder body and an air-permeable, porous covering element fitted to the basic cylinder body and having a multiplicity of interconnected channels formed therein, the channels being connectable to one of a suction-air source and a blast-air source via air feed lines for sucking a sheet carried on the cylinder onto the peripheral surface of the cylinder or for lifting the sheet off the peripheral surface of the cylinder.

In accordance with an added feature of the invention, the air feed lines are formed in the basic cylinder body.

In accordance with an additional feature of the invention, as viewed in the direction of rotation of the cylinder, during first-form and perfecting operation, the control device serves to connect the recesses, in the region between a transfer center line between the cylinder and a downline sheet-conveying cylinder and a printing nip, to the blast-air source, so as to detach the sheets from the peripheral surface of the cylinder.

In accordance with yet another aspect of the invention, there is provided a method for producing a printing-machine cylinder, which comprises the steps of making a basic cylinder body ready; forming recesses in a peripheral surface of the basic body; introducing at least one air-supply bore into the recesses; fitting a cylinder covering element to the basic cylinder body, the cylinder covering element having, in the region of the recesses, a multiplicity of through-channels extending from the recesses to the peripheral surface of the cylinder covering element.

In accordance with yet an added aspect of the invention, there is provided a method for producing a printing-machine cylinder, which comprises the steps of making a basic cylinder body ready; making a cylinder covering element ready; forming recesses in the inside of the cylinder covering element; introducing into the cylinder covering element a multiplicity of through-channels, extending from the recesses to the peripheral surface of the cylinder covering element; forming at least one air-supply bore in the basic cylinder body; and fitting the cylinder covering element to the basic cylinder body.

In accordance with another mode, the method of the invention includes the further step of applying a porous film or foil to the peripheral surface.

In accordance with an additional aspect of the invention, there is provided a method for producing a printing-machine cylinder, which comprises the steps of providing a basic cylinder body; introducing an air-feed line into the peripheral surface of the basic cylinder body; and fitting a porous, air-permeable cylinder covering element to the basic cylinder body.

In accordance with another feature and mode of the cylinder and the method of the invention, the cylinder is an impression cylinder for a sheet-fed rotary printing machine.

In accordance with a concomitant feature of the printing machine of the invention, the printing machine is a sheet-fed rotary printing machine, and the cylinder is an impression cylinder.

Other features which are considered as characteristic for the invention are set forth in the appended claims.

Although the invention is illustrated and described herein as embodied in a printing-machine cylinder, especially an impression cylinder, for a sheet-fed rotary printing machine, and a method of production thereof, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
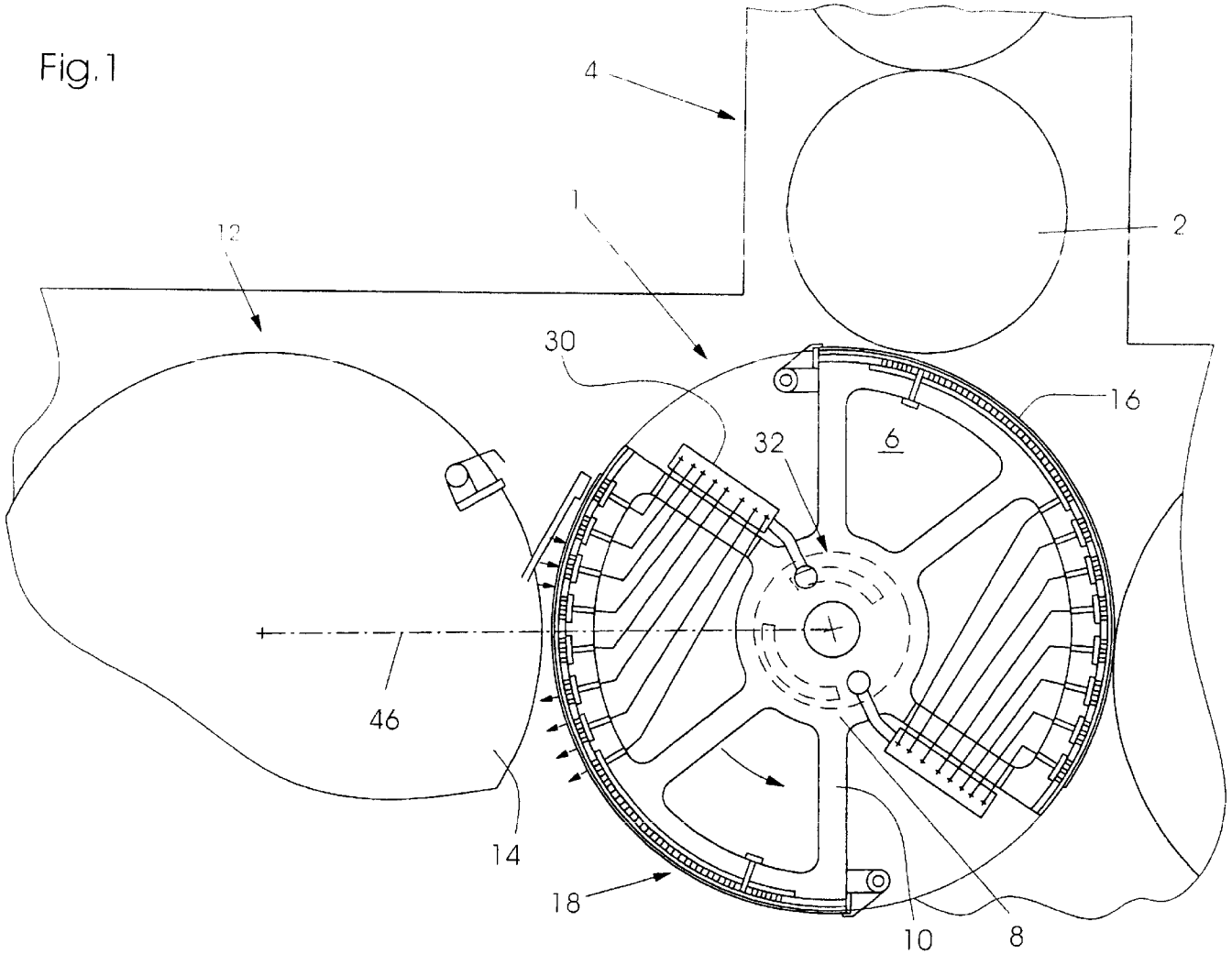
FIG. 1 is a fragmentary diagrammatic side elevational view of a sheet-fed rotary printing machine having a printing-machine cylinder according to the invention, that is formed as an impression cylinder, disposed upline of a reversing or turning device.

Referring now to the drawings and, first, particularly to FIG. 1 thereof, there is diagrammatically illustrated therein a printing-machine cylinder 1 according to the invention that is preferably an impression cylinder cooperating with an associated blanket cylinder 2, in a printing unit 4 of a sheet-fed rotary printing machine. The cylinder 1 has a basic body 8 which, in the preferred embodiment of the invention, is formed as a casting provided with cavities 6 and ribs 10, for example, a casting made of gray cast iron. As is further illustrated in FIG. 1, the printing-machine cylinder 1 according to the invention is preferably used in a printing unit 4 arranged upline of a reversing or turning device 12. The reversing device 12 is indicated diagrammatically in FIG. 1 by a reversing or turning drum 14 having an otherwise unidentified suction gripper and an accepting or take-over gripper. In the same way, however, it is also possible to use the printing-machine cylinder 1 according to the invention as a transfer cylinder arranged between two printing units of a sheet-fed rotary printing machine, on the peripheral surface of which the sheets 16 freshly printed in the preceding printing unit are carried without smearing by using blast or blown air or, if required, or example during perfecting operation, are sucked onto the peripheral surface in order to smoothen the sheets 16.

Figure 2A:
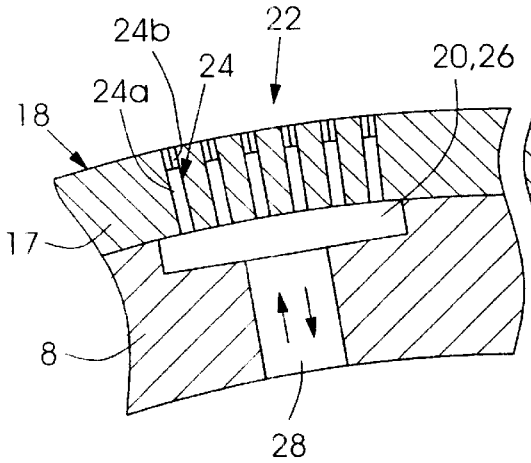
FIGS. 2A and 2B are fragmentary diagrammatic longitudinal sectional views of the outer surface of a first embodiment of a printing-machine cylinder according to the invention, wherein both through-channels and fine openings arranged above the latter are formed directly in a covering element of the cylinder, in FIG. 2A recesses and distribution chambers are formed in a basic body, in FIG. 2B recesses and distribution chambers are formed in a covering element of the cylinder.
Figure 3A:
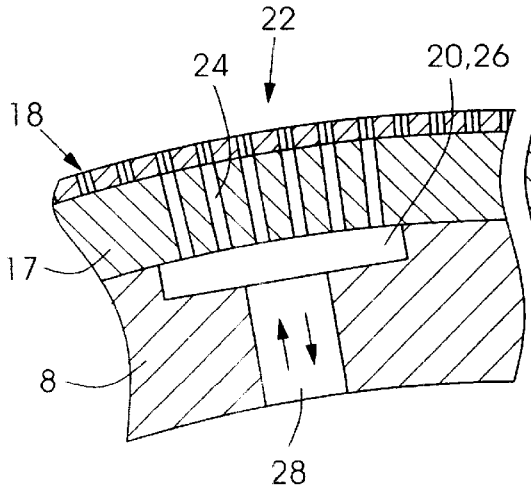
FIGS. 3A and 3B are fragmentary diagrammatic longitudinal sectional views of another embodiment of a printing-machine cylinder according to the invention, wherein through-channels are formed in the covering element of the printing-machine cylinder and are covered by a porous film stretched over the peripheral surface of the covering element, in FIG. 3A recesses and distribution chambers are formed in a basic body, in FIG. 3B recesses and distribution chambers are formed in a covering element of the cylinder.
Figure 4A:
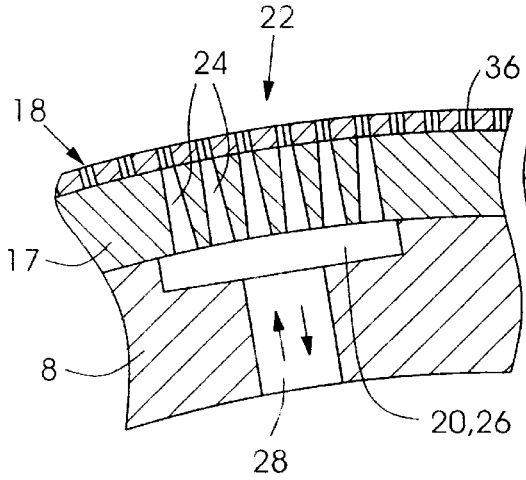
FIGS. 4A and 4B are fragmentary diagrammatic longitudinal sectional views of a further embodiment of a printing-machine cylinder according to the invention, wherein through-channels in the covering element have a cross section widening towards the center of the cylinder, in FIG. 4A recesses and distribution chambers are formed in a basic body, in FIG. 4B recesses and distribution chambers are formed in a covering element of the cylinder.

As is illustrated in the enlarged sectional views of the basic body 8 of the printing-machine cylinder 1 according to the invention in FIGS. 2A, 3A and 4A, recesses 20 are machined in the basic body 8, it being possible, for example, for the recesses 20 to be milled into the basic body 8 in the course of a rough machining of the latter after it has been cast. In a similar manner, however, provision may also be made for the basic structure of the recesses 20 to be provided in the peripheral surface of the basic body 8 during casting, and for these then to be subsequently machined as necessary or desirable.

The recesses 20 define air distribution chambers 26, which are connectable via an air feed line 28 to an otherwise non-illustrated blast-air or suction-air source, it being possible for the flow connection between the blast-air or suction-air source and the air distribution chambers 26 to be made preferably via one or more valves 30, illustrated diagrammatically as a block in FIG. 1, and a control device 32, in the form of a conventional rotary lead-through or a rotary valve.

After the machining of the basic cylinder body 8, a solid covering element 17 is fitted to the peripheral surface of the latter, for example, pushed or slid on axially. The covering element 17 may have a thickness of approximately 10 mm, for example, and is formed in the vicinity of the recesses 20 with through-channels 24 which define blasting/suction regions or sections 22 on the peripheral surface 18 of the cylinder 1.

Figure 2B:
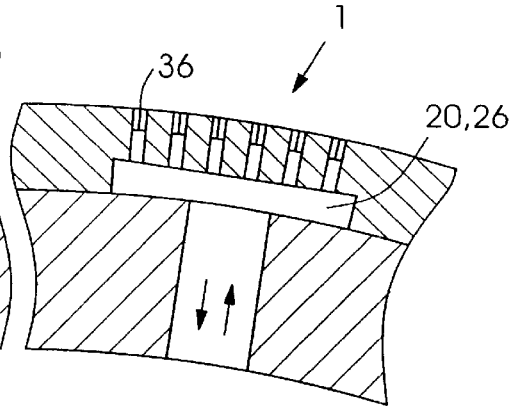

In the embodiment of the invention illustrated in FIGS. 2A and 2B, each of the through-channels 24 (not shown in FIG. 2B) has a channel section 24*a* (not shown in FIG. 2B) of larger diameter formed in the covering element 17 from the center of the cylinder 1, as well as a number of sections 24*b* which are arranged above and communicate with the section 24*a* and have a diameter that is several times smaller. The diameter of the channel sections 24*a* may, for example, be in the range between 0.5 mm and 1.5 mm, while the diameter of the channel sections 24*b* may be in the range from 0.05 to 0.2 mm.

Figure 3B:
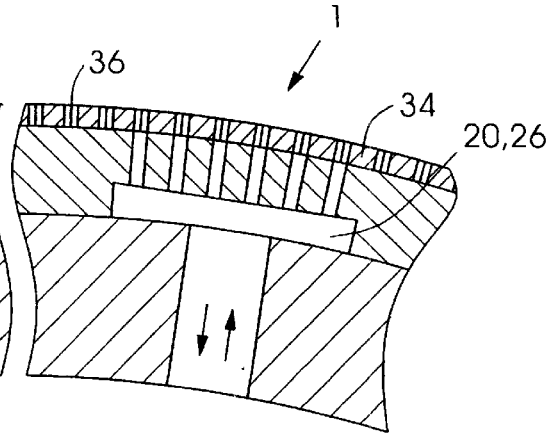

With regard to the further embodiment of a printing-machine cylinder 1 according to the invention illustrated in FIGS. 3A and 3B, a porous film or foil 34 can be applied to the outer peripheral surface of the covering element 17, the channel sections of smaller diameter 24*b* being formed in this film or foil 34, for example, by a laser or by etching, and so forth. Porous textured films or foils, for example, in the form of glass-bead blankets or so-called textured chromium coverings have become known heretofore, for example, from the European Patent 0 165 477. The film or foil 34 can, for example, be stretched onto the peripheral surface 18 of the covering element 17 or else adhesively bonded thereon and is used to distribute the impression pressures, which act in the printing nip when a cylinder 1 according to the invention is used as an impression cylinder, uniformly in the region of the through-channels 24 (not shown in FIG. 3B), in order to avoid the occurrence of offprints or reproductions in the printed image due to the channels 24.

Figure 4B:
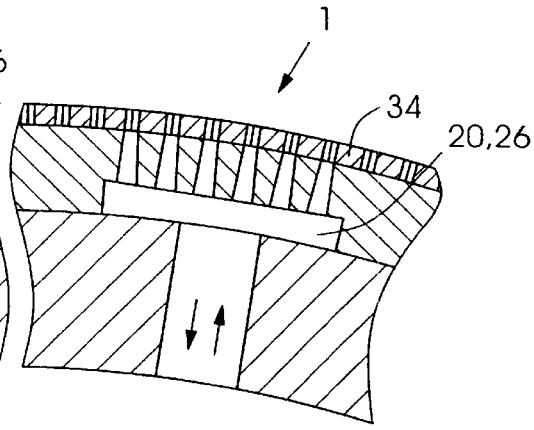

As is shown in FIGS. 4A and 4B, in an embodiment of the invention that likewise uses a porous film or foil 34, provision may furthermore be made for the channel sections 24*a* of the through-channels 24 (not shown in FIG. 4B) to have a cross section that widens in the direction of the air distribution chamber 26, it being possible for the cross section of the through-channels 24 in the region of the air distribution chambers 26 to be twice as large, for example, as the cross section at the opposite end of the through-channels 24. In the case of suction-air operation of the printing-machine cylinder 1, this results in a considerably reduced susceptibility to failure with respect to blockages, which can be caused, for example, by the penetration of paper dust or other particles into the through-channels 24.

The production of the covering element 17 with the through-channels 24 arranged therein is advantageously performed independently of the machining of the basic cylinder body 8. The multiplicity of through-channels 24 may thereby be introduced into the peripheral surface 18 of the covering element 17, for example, with the aid of suitable tools, such as batteries of drills or laser machining tools, which results in considerable advantages from a production point of view. Thus, because of the separate machining, in the event of breakage of a drilling tool during the drilling of the through-channels 24, for example, no damage occurs to the basic cylinder body 8, which is considerably more complicated to produce, as is the case, for example, during the production of printing-machine cylinders in accordance with the prior art, wherein the channels are generally introduced directly into the peripheral surface of the unipartite cylinder body. Furthermore, the machining time is reduced considerably by the separate machining of the covering element 17 and the basic cylinder body 8, because some of the successively performed machining steps in the case of unipartite cylinders can then be performed simultaneously on different machining devices.

After the cylinder covering element has been produced in the manner described hereinbefore, preferably by machining a flat metal plate, it is applied to the peripheral surface of the roughly prepared basic cylinder body 8 and affixed to the latter, for example, by being screwed from the inside or by being adhesively bonded or welded. In this regard, provision may be made for he covering element 17 to be provided beforehand with a permanent curvature corresponding to the curvature of the outer peripheral surface of the basic cylinder body 8, for example, by a plastic deformation process, so that the covering element 17 is held in a substantially stress-free manner on the basic cylinder body 8. Provision can also be made for the covering element 17 to be provided beforehand with a more pronounced curvature than the cylinder curvature, so that after the covering element 17 has been applied to the basic cylinder body 8, it is prestressed in the outer regions.

In a further step, a fine machining of the peripheral surface of the covering element 17 fitted to the basic cylinder body 8 can, if necessary or desirable, then take place, by which irregularities in the roundness of the cylinder, which generally lead to a disadvantageous impairment of the printed image, are eliminated.

Figure 5A:
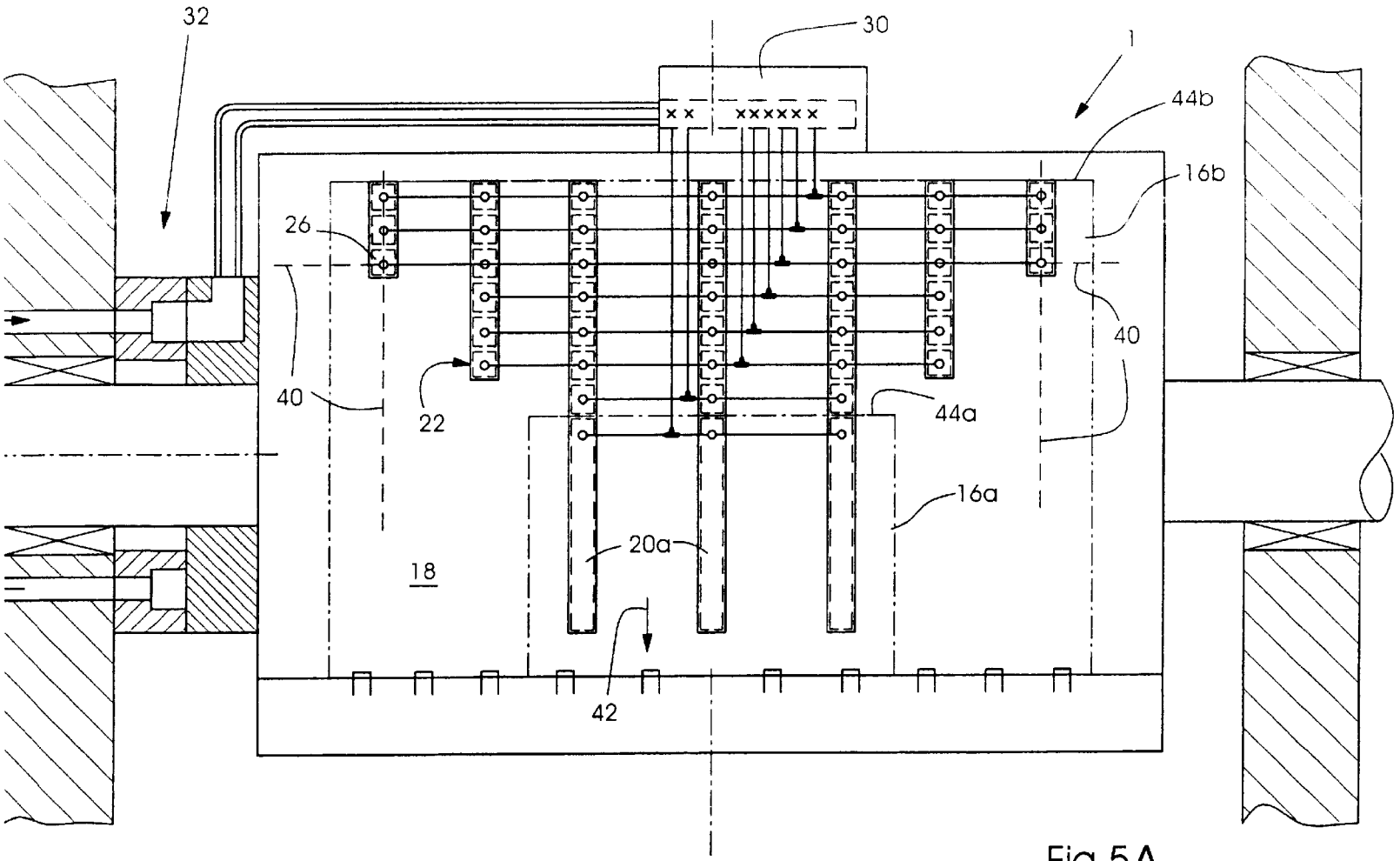
FIGS. 5A and 5B are diagrammatic and schematic side elevational views, partly in section, of an embodiment of a printing-machine cylinder according to the invention, wherein the blast/suction regions are arranged in rows on the peripheral surface of the cylinder, in FIG. 5A the rows are parallel to each other, in FIG. 5B the rows are arranged in a V-shape configuration.
Figure 5B:
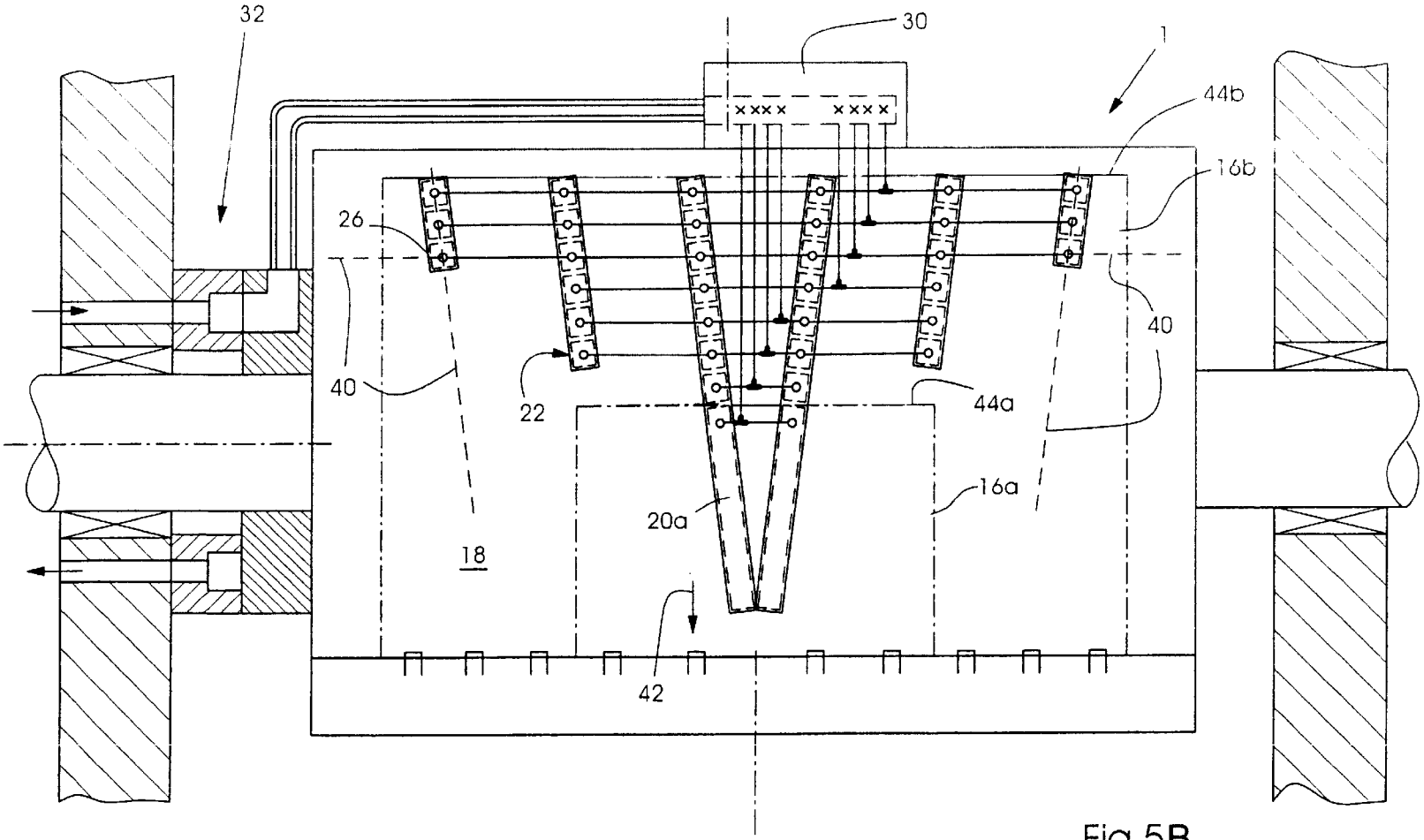

As is illustrated in FIGS. 5A and 5B, in the preferred embodiment of the invention, the recesses 20 are formed in the peripheral surface of the basic cylinder body 8 as grooves 20*a*, the blasting/suction sections 22 having the form of strips. In this regard, a number of air distribution chambers 26, to which blast air or suction air can be applied separately from one another, are preferably arranged along one of the groove-like recesses 20*a*. The grooves 20*a* can extend both in the peripheral direction and in the axial direction along the peripheral surface 18 of the printing-machine cylinder 1. As is further shown in FIG. 5A, the blasting/suction sections 22 on the peripheral surface 18 of the cylinder 1 are preferably arranged in parallel rows 40, which can extend both in the peripheral direction and in the axial direction over the peripheral surface 18. In the same manner, as shown in FIG. 5B, provision can also be made for the rows 40 to run in a substantially V-shape or ray shape on the peripheral surface 18 of the cylinder 1. This can be achieved, for example, by the rows 40 extending in the axial direction, as viewed in the direction of rotation 42 of the cylinder 1, having a decreasing length, as a result of which, in the case of a sheet 16*a* of small format, only the blasting/suction sections 22 in the region of the sheet trailing edge 44*a* in the center of the peripheral surface 18 of the cylinder 1 apply suction to the small-format sheet 16*a*. During the processing of large-format sheets 16*b*, which generally have a greater weight and are therefore subject to the action of a greater centrifugal force, by contrast preferably all the blasting/suction sections 22 on the peripheral surface 18 are activated to apply suction air or blast air to the sheets 16, so that large-format sheets 16*b* are held on the peripheral surface 18 over virtually the entire area thereof and not just in the region of the sheet trailing edge 44*b* thereof.

As is indicated by the valves of the valve block 30 in FIGS. 5A and 5B, the blasting/suction sections 22 of the axial rows 40, or the air distribution chambers 26 thereof, can preferably have blast air or suction air applied thereto in groups, the application being performed in dependence upon the sheet format to be processed, in such a manner that blast air or suction air is applied only to those sections 22 underneath a sheet 16 conveyed on the cylinder. In such an embodiment of the invention, preferably all of the sections 22 and the air, distribution chambers 26 thereof, respectively, are connected simultaneously to the suction-air or blast-air source, via the valve block 30 and via the control device 32 in the form of a conventional rotary lead-through.

In the same manner, provision can be made for the axial rows 40, as viewed in the peripheral direction, to have suction air applied thereto progressively via the control device 32 after the printing nip has been passed, or shortly beforehand, so that the transported sheets 16 are sucked progressively onto the peripheral surface 18 of the cylinder 1 and are smoothened. In the same manner, the rows 40 of blasting/suction sections 22 can have blast air or blast-air pulses applied thereto progressively from a specific, predefined rotational-angle position, in order to detach the sheets 16 from the peripheral surface 18 or to clean the channels 24 of contaminants.

Especially when the printing-machine cylinder 1 according to the invention is used as an impression cylinder in a printing unit arranged upstream of a reversing or turning device, it has proven to be advantageous to apply suction air to the sections 22 arranged along an axial row 40, or the distribution chambers 26 thereof, in the region between the printing nip and the transfer center line 46 to the downline reversing or turning drum 14 (FIG. 1), and to apply blast air to the corresponding axial rows 40 underneath the sheet trailing edge 44*a*, 44*b* only directly before and directly after, respectively, the sheet trailing edge 44*a*, 44*b* has been gripped by a gripper device of the reversing or turning drum 14, in order to detach the sheet 16 sucked onto the peripheral surface 18 from the latter.

Furthermore, the possibility exists of forming the recesses 20 and distribution chambers 26 directly on the inside of the cylinder covering element 17 and of introducing only the suction holes 28 into the basic cylinder body 8, as is shown in FIGS. 2D to 4B.

Figure 6:
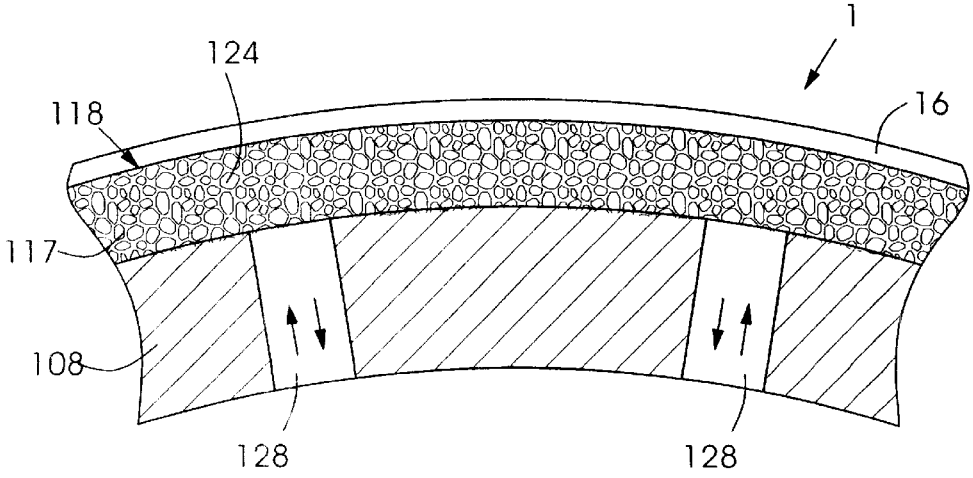
FIG. 6 is a fragmentary diagrammatic longitudinal sectional view of yet another embodiment of a printing-machine cylinder according to the invention, wherein the cylinder covering is produced from a porous, air-permeable material.

According to a further embodiment of the invention, which is illustrated in FIG. 6 and in which parts corresponding to those in the preceding figures are identified by a reference numeral increased by 100, the cylinder covering element 117, that is fitted on the basic cylinder body 108 having air feed lines 128 formed therein, is formed from porous material. The material of the porous covering element 117 may be, for example, metal, ceramic or also plastic, it being possible for the microscopically small connecting channels 124 contained in the porous material of the cylinder cover 117 to be produced, for example, by etching or by sintering or in some other conventional manner. The connecting channels 124 are preferably also interconnected in the transverse direction and connect the peripheral surface 118 of the cylinder 1 to the air feed channels 128 in the basic cylinder body 108 in such a way that a sheet 16 carried on the cylinder 1 is preferably sucked onto the peripheral surface 118 over the entire area during suction-air operation and is lifted off the cylinder peripheral surface 118 during blast-air operation.

In the same manner as for the blasting/suction sections 22 of the aforedescribed embodiments of FIGS. 2, 3 and 4, the air feed channels 128 of the embodiment shown in FIG. 6 can likewise be arranged along rows (not shown), and can have blast air or suction air applied thereto, region by region, via control devices, for example, rotary valves 32 (FIG. 1).

We claim:

1. A printing-machine cylinder comprising:

a cylinder body having a multiplicity of channels connected to one of a suction-air source and a blast-air source;

a covering element fitted to said cylinder body and having a multiplicity of through-channels with channel sections of varying diameters, at least two through-channels of said multiplicity of through-channels being connected to one of said channels and extending to a peripheral surface of said covering element defining blasting/suction sections for acting upon a underside of a sheet conveyed.

2. The printing-machine cylinder according to claim 1, further comprising:

a multiplicity of recesses formed in one of said cylinder body and said covering element, said recesses being connected to said channels of said cylinder body and to said through-channels of said covering element.

3. The printing-machine cylinder according to claim 1, wherein said through-channels have a channel section of relatively smaller diameter at said peripheral surface of said covering element.

4. The printing-machine cylinder according to claim 3, wherein said section of relatively larger diameter is formed as a bore in said covering element and extends in a direction from the center of the cylinder.

5. The printing-machine cylinder according to claim 1, wherein said blasting/suction sections are arranged substantially in rows on the peripheral surface of the cylinder.

6. The printing-machine cylinder according to claim 5, wherein said rows extend substantially parallel to one another.

7. The printing-machine cylinder according to claim 5, wherein said rows extend in the axial direction.

8. The printing-machine cylinder according to claim 7, wherein, as viewed in the direction of rotation of the cylinder, said rows are of decreasing length.

9. The printing-machine cylinder according to claim 5, wherein said rows extend in the peripheral direction.

10. The printing-machine cylinder according to claim 5, wherein said rows extend substantially in a V-shape or ray shape.

11. The printing-machine cylinder according to claim 5, including a connecting line for applying one of suction air and blast air in common to the recesses assigned to a row.

12. The printing-machine cylinder according to claim 1, including valves assigned to said recesses for connecting said recesses, individually or in groups, to the one of the suction-air source and the blast-air source.

13. The printing-machine cylinder according to claim 11, wherein said recesses are subjectible to the application of said one of suction air and blast air depending upon the sheet format to be processed, in a manner that only said blast/suction sections underneath a sheet conveyed on the cylinder have said one of suction air and blast air applied thereto.

14. The printing-machine cylinder according to claim 1, including a control device for controlling a feeding of said one of suction air and blast air to said channels.

15. The printing-machine cylinder according to claim 14, wherein all of said recesses are connectable simultaneously to said one of the suction-air and blast-air sources via said control device.

16. The printing-machine cylinder according to claim 1, wherein said through-channels in said covering element have a cross section widening in a direction towards said channels.

17. The printing-machine cylinder according to claim 3, wherein said peripheral surface of said covering element has a porous film applied thereto, wherein those sections of said through-channels which have a relatively smaller diameter are formed.

18. A printing machine having the cylinder according to claim 14, wherein the cylinder is an impression cylinder arranged upline of a reversing device, said control device, during first-form and perfecting operation, serving to connect said recesses, in a region between a printing nip and a transfer center line between said impression cylinder and a downline sheet-carrying cylinder, to the suction-air source, in order to hold the sheets on the peripheral surface of the cylinder.

19. A printing machine having the cylinder according to claim 14, wherein said control device, during first-form and perfecting operation, serves to connect said recesses to the blast-air source, in a transfer region that is one of directly upstream and directly downstream of the transfer center line and wherein a trailing edge of the sheet is acceptable by a gripper device of a downline sheet-carrying cylinder.

20. The printing-machine cylinder according to claim 14, wherein, as viewed in the direction of rotation of the cylinder, during first-form and perfecting operation, said control device serves to connect said recesses to the blast-air source, in the region between a transfer center line between the cylinder and a downline sheet-conveying cylinder and a printing nip, so as to detach the sheets from the peripheral surface of the cylinder.

21. The printing-machine cylinder according to claim 1, wherein the cylinder is an impression cylinder for a sheet-fed rotary printing machine.

22. The printing machine according to claim 19, wherein the printing machine is a sheet-fed rotary printing machine, and the cylinder is an impression cylinder.

23. A printing-machine cylinder, comprising:

a cylinder body having a multiplicity of channels connected to one of a suction-air source and a blast-air source;

a covering element fitted to said cylinder body and formed with a multiplicity of through-channels connected to said channels;

a porous film fitted to said covering element, said porous film connected to said through-channels and having a peripheral surface defining blasting/suction sections for acting upon a underside of a sheet conveyed.

* * * * *